US009714629B2

(12) United States Patent
Prem

(10) Patent No.: US 9,714,629 B2
(45) Date of Patent: Jul. 25, 2017

(54) THROTTLE VALVE APPARATUS FOR AN INTERNAL COMBUSTION ENGINE AND MOTOR CYCLE PROVIDED THEREWITH

(71) Applicant: KTM AG, Mattighofen (AT)

(72) Inventor: Rudolf Prem, Zell am Moos (AT)

(73) Assignee: KTM AG, Mattighofen (AT)

( * ) Notice: Subject to any disclaimer, the term of this patent is extended or adjusted under 35 U.S.C. 154(b) by 155 days.

(21) Appl. No.: 14/931,251

(22) Filed: Nov. 3, 2015

(65) Prior Publication Data

US 2016/0123284 A1 May 5, 2016

(30) Foreign Application Priority Data

Nov. 3, 2014 (DE) ..... 10 2014 115 954

(51) Int. Cl.

| | |
|---|---|
| ***F02M 35/10*** | (2006.01) |
| ***F02D 9/10*** | (2006.01) |
| *F02D 9/02* | (2006.01) |
| *F02M 35/16* | (2006.01) |
| *F02M 1/02* | (2006.01) |
| *F02D 11/02* | (2006.01) |
| *F02D 11/04* | (2006.01) |

(52) U.S. Cl.

CPC ..... *F02M 35/10255* (2013.01); *F02D 9/1055* (2013.01); *F02D 9/02* (2013.01); *F02D 9/1065* (2013.01); *F02D 11/02* (2013.01); *F02D 11/04* (2013.01); *F02D 2009/025* (2013.01); *F02M 1/02* (2013.01); *F02M 35/162* (2013.01)

(58) Field of Classification Search

CPC ..... F02M 35/10; F02M 35/16; F02M 1/02; F02M 35/162; F02M 35/10255; F02D 9/02; F02D 2009/025; F02D 9/1055; F02D 9/1065; F02D 11/02; F02D 11/04

See application file for complete search history.

(56) References Cited

U.S. PATENT DOCUMENTS

| | | | | |
|---|---|---|---|---|
| 3,714,933 | A * | 2/1973 | Ozaki | F02M 31/06 123/552 |
| 4,513,700 | A * | 4/1985 | Hayashida | F02M 3/07 123/179.16 |
| 5,515,825 | A | 5/1996 | Arai et al. | |
| 6,966,299 | B2 * | 11/2005 | Miyamoto | F02D 37/02 123/339.11 |
| 2006/0005808 | A1 | 1/2006 | Blomenberg et al. | |
| 2006/0170120 | A1 | 8/2006 | Takano et al. | |

FOREIGN PATENT DOCUMENTS

| | | | |
|---|---|---|---|
| DE | 7908299 | U1 | 7/1979 |
| DE | 20012534 | U1 | 2/2000 |
| DE | 10152437 | A1 | 5/2002 |
| DE | 102008007922 | A1 | 8/2008 |
| DE | 102010009915 | A1 | 9/2010 |

* cited by examiner

*Primary Examiner* — Hieu T Vo

(74) *Attorney, Agent, or Firm* — Larson & Larson, P.A.; Frank Liebenow

(57) ABSTRACT

Proposed is a throttle valve apparatus for an internal combustion engine, with a housing and an intake pipe comprising a through-flow cross section and a throttle valve that is pivotable relative to the through-flow cross section, which is actuatable by means of a throttle valve shaft and with an actuating device arranged on the housing, by means of which the throttle valve can be releasably fixed in a cold starting position in which the through-flow cross section is at least partially opened.

20 Claims, 10 Drawing Sheets

Detail A

THROTTLE VALVE APPARATUS FOR AN INTERNAL COMBUSTION ENGINE AND MOTOR CYCLE PROVIDED THEREWITH

FIELD

The present invention relates to a throttle valve apparatus for an internal combustion engine, with a housing and an intake pipe comprising a through-flow cross section and a throttle valve that can be pivoted relative to the through-flow cross section, which can be actuated by means of a throttle valve shaft, according to the preamble of claim 1.

BACKGROUND

Such a throttle valve apparatus can serve for the metered feeding of an air-fuel mixture to an internal combustion engine, which for example controlled via an electronic device, receives fuel fed into the intake pipe corresponding to the respective throttle valve angle, which is then fed to the internal combustion engine. In the case of such an internal combustion engine operating with intake pipe injection, the power output by the internal combustion engine is thus controlled via the throttle valve in that the fed-in quantity of air-fuel mixture is influenced by means of the throttle valve in that the cross section in the intake pipe through which a flow can flow is changed relative to the through-flow cross section by the angular position of the throttle valve.

In the case of an internal combustion engine with injection of the fuel directly into a working cylinder of the internal combustion engine, the quantity of combustion air fed into the internal combustion engine is influenced via the throttle valve, again via a change of the angular position of the throttle valve relative to the through-flow cross section in the intake pipe.

When an internal combustion engine that is not yet at normal operating temperature is started, the power to be output by the internal combustion engine for bringing about stable idling is higher than at normal operating temperature, since in the cold state the frictional torque of the internal combustion engine is higher than in the state at operating temperature. This can be offset with an idle rotational speed of the internal combustion engine that is elevated in cold starting mode.

In the case of a known internal combustion engine operating with a carburettor for fuel atomisation, the air-fuel mixture for this purpose was enriched by way of throttling the quantity of intake air to be fed in via the main intake air duct.

By way of DE 79 08 299 U1, an automatically resetting starting carburettor to a main carburettor has become known, in the case of which for initiating the starting process a starting slide is brought into a raised position by means of an actuating part and the starting slide via a pawl held in this position until after termination of the starting process the user of the engine renders the main carburettor operational through initial actuation of the main gas slide, the starting carburettor thereby being automatically put out of service.

By way of DE 39 26 424 A1, a throttle valve for an internal combustion engine has become known, which is actuated via an electric motor. When by a control device activating the electric motor an emergency is detected, during which the throttle valve could close up to an opening angle of 0 degree, i.e. the internal combustion engine would no longer be supplied with air-fuel mixture, the throttle valve is held in an opening position via a stop pin, which is extended by an hydraulically actuated stop actuator, so that the internal combustion engine can be continuously supplied with an air-fuel mixture and idling of the internal combustion engine thereby being ensured.

By means of US 2006/0005808 A1 a throttle valve for a motor cycle has become known, which is actuated by the user of the motor cycle via a control cable. In addition to the control cable actuation, the throttle valve can be additionally actuated by an electrically driven actuator, which overrides the manual actuation of the throttle valve when by an electronic control device of the motor cycle it is detected that the motor cycle is in a special operating mode. The special operating mode can be a passing mode of the motor cycle, during which the same is accelerated with a predetermined acceleration for measuring the noise emissions of the motor cycle. In such a state, the electrically driven actuator then reduces the opening angle of the throttle valve in order to reduce the power output by the internal combustion engine of the motor cycle, thereby reducing the noise emissions.

In particular in the case of competition motor cycles it is important to keep the dead weight of the vehicle low, which is why such vehicles are often equipped with a control cable-actuated throttle valve, i.e. an electric motor for actuating the throttle valve is omitted. In the case of a known motor cycle operating with fuel injection with control cable-actuated throttle valve, a bypass system for the cold starting mode of the internal combustion engine is provided and the bypass can be opened or closed for cold starting operation by the driver of the motor cycle.

However, this system has the disadvantage that the idle speed control via the bypass distorts the map (manifold pressure signal) sensor signal and an electronic control device (ECU, engine control unit) provided for the control of the internal combustion engine uses the distorted sensor signal for determining the fuel quantity to be injected. In addition, the ECU cannot detect the change of the idle air performed by the driver and makes available an unchanged quantity of fuel although more or less idle air is fed in through the bypass. This results in that the raw emission values of the internal combustion engines increase and no stable idling in cold starting mode is achieved.

When the fuel injection system is operated in cold starting mode, the bypass is open so that during the opening of the throttle valve the vacuum that is present in the bypass drops, as a result of which the flow of air through the bypass is reduced and a transition region is created that can only be matched with difficulty which results in that the response behaviour of the internal combustion engine deteriorates and differs from the response behaviour in the case of an internal combustion engine at operating temperature. This in turn results in that the driver, which expects spontaneous and stable response behaviour of the internal combustion engine, frequently warms up the internal combustion engine in the stationary state by specifically revving up the engine until it has reached the normal operating temperature.

SUMMARY

Starting out from this, the present invention is based on the object of creating a throttle valve apparatus which avoids these disadvantages and makes available a cold starting system that is simple to operate for the driver. In addition, an internal combustion engine and a motor cycle with the throttle valve apparatus to be created is to be made available.

For solving this object with respect to the throttle valve apparatus, the invention comprises the features stated in claim 1. Advantageous configurations thereof are described in the further claims. In addition to this, the invention, with respect to the internal combustion engine, has the features stated in claim 15 and with respect to the motor cycle the features stated in claim 16.

The invention creates a throttle valve apparatus for an internal combustion engine, with a housing and an intake pipe having a through-flow cross section and a throttle valve that can be pivoted relative to the through-flow cross section, which can be actuated by means of a throttle valve shaft and an actuating device arranged on the housing, by means of which the throttle valve can be releasably fixed in a cold starting position which at least partially opens the through-flow cross section.

The internal combustion engine can for example be a one-cylinder motor cycle cylinder engine, which is provided for driving a competition motor cycle, for example an off-road sports motor cycle. Independently thereof, the throttle valve apparatus according to the invention however can also be employed with one-cylinder or multiple-cylinder internal combustion engines of other vehicles. The internal combustion engine can be an internal combustion engine operating with direct fuel injection or intake pipe injection, but it can also be a supercharged internal combustion engine. Although intake pipe is mentioned, this also comprises the case that the internal combustion engine operation is supercharged.

The throttle valve apparatus according to the invention quite in general comprises a housing which is designed for receiving or arranging usual components of a throttle valve apparatus such as for example a throttle valve shaft, and also for example a device, with which the actuating force exerted by the driver is transmitted to the throttle valve shaft. The throttle valve apparatus according to the invention also comprises a throttle valve that is pivotably arranged for example in the intake pipe, with which the through-flow cross section of the intake pipe can be changed. The throttle valve apparatus according to the invention comprises an actuating device, by means of which the throttle valve can be releasably fixed in a cold starting position at least partially opening the through-flow cross section. The cold starting position of the throttle valve in this case is a position in which the through-flow cross section in an internal combustion engine provided with a throttle valve apparatus according to the invention for the cold starting mode is opened in a suitable manner.

The cold starting position can thus be also a position of the throttle valve which further opens the through-flow cross section of the intake pipe than the position of the throttle valve that is necessary for the idle speed operation of the internal combustion engine in the state at operating temperature. With the throttle valve thus opened further, the internal combustion engine is fed more combustion air than is necessary during the idle speed operation in the state at operating temperature. This state is detected by a sensor that cooperates with the ECU, which for example releases a corresponding quantity of fuel parameterised in a characteristic map for injection.

Through the actuating device the throttle gap formed between the throttle valve and the intake pipe is thus enlarged so that a greater quantity of combustion air can be fed to the internal combustion engine for the cold start than is necessary for the idle speed operation in the state at operating temperature. Thus, the need for an idle speed bypass system, as was explained above, ceases to exist.

Easily accessible, the actuating device can be put into service by the driver of the vehicle before initiating the cold starting process so that the throttle gap during the cold starting process is already enlarged and a vacuum forms in the intake pipe, which is detected by a sensor and passed on to the ECU, which then releases a fuel quantity for injection that is slightly elevated compared with the idle speed operation in the state at operating temperature, so that a stable cold starting idle speed materialises, which is not influenced by changing negative pressure values in a bypass system.

When the driver of the vehicle that is operated with the throttle valve apparatus according to the invention carries out a starting process, he thereby enlarges the throttle gap slightly further by accelerating on the accelerator twist grip or accelerator pedal, the pressure conditions in the intake pipe change and the ECU can release a fuel quantity for injection that is changed corresponding to these changed conditions. The transition region that is difficult to match and which was described above ceases to exist since by the driver opening the throttle valve the negative pressure conditions in the idle air bypass system cannot change since it has become subject to the omission. The engine operated thus immediately has a response behaviour corresponding to the desire of the driver without the driver having to make use of his behaviour of bringing the cold engine up to operating temperature in stationary operating mode. Since intake pipe signals that are distorted by a bypass system are not present in the cold starting mode either, the raw emissions of the internal combustion engine can be reduced, the load on the environment is reduced.

According to a further development of the invention it is provided that the throttle valve shaft is actuatable in opening direction of the throttle valve by means of at least one control cable and the control cable is arranged operationally connected with a control cable drum arranged in the housing, which is coupled to the throttle valve shaft. This configuration has the advantage that the control cable drum is protected from damage and dirt due for example to stones, dust, dirt particles and the like swirled up for example by the front wheel of the motor vehicle.

According to a further development of the invention it is also provided that the throttle valve shaft is actuatable in closing direction of the throttle valve by means of at least one control cable and the control cable is arranged operationally connected with a control cable drum arranged in the housing, which is coupled to the throttle valve shaft. This control cable drum for the closing control cable can be an independent control cable drum that is operationally connected with the throttle valve shaft, which is provided independently from the control cable drum for the opening control cable. It is also possible that both the opening control cable and also the closing control cable actuate a common control cable drum which is operationally connected with the throttle valve shaft so that the throttle valve can be both actively opened and also actively closed by the driver of the vehicle, namely with the help of the corresponding control cable. This configuration also has the advantage that the throttle valve to be opened against the effect of a return spring can be again actively closed by the driver of the vehicle even in the case of a possible malfunctioning of the return spring.

Here it is provided according to a further development of the invention that the actuating device is designed for manual activation for bringing about the cold starting position of the throttle valve in which the through-flow cross section is at least partially opened and for cancelling this position. This means in other words that the driver of the vehicle can simply manually activate the actuating device before the cold starting process without complex electronic control devices or the like so that the throttle valve assumes its cold starting position and also can again deactivate the actuating device manually directly on the actuating device or through mechanical remote access to the actuating device, i.e. return it from its cold starting position into the position for the engine at operating temperature.

According to an advantageous embodiment it is provided that the actuating device for cancelling the cold starting position of the throttle valve in which it at least partially opens the through-flow cross section is designed by means of actuation by a control cable. This configuration is a possibility of remote access or remote actuation of the throttle valve from the cold starting position by the driver of the vehicle. For deactivating the cold starting position of the throttle valve, an independent, i.e. separate control cable can also be provided on the vehicle.

According to a further development of the invention it is provided that the actuating device can be brought, by means of a control cable for actuating the throttle valve in closing direction, from the actuated cold starting position of the throttle valve in which the through-flow cross section is at least partially opened into a position of the throttle valve in which the same is unactuated by the actuating device. This means in other words that the driver of the vehicle can simply cancel the cold starting position of the throttle valve in that he actuates the control cable for actuating the throttle valve in closing direction, that is for example in the case of an accelerator twist grip provided on a motor cycle, turns the accelerator twist grip in forward direction, that is in closing direction of the throttle valve, as a result of which the actuating device is shifted out of its position in which it holds the throttle valve in cold starting position namely into a position in which the throttle valve is no longer held in the cold starting position, as a result of which the throttle gap in the intake pipe that is enlarged in cold starting position is reduced.

The driver of the vehicle equipped with the throttle valve apparatus according to the invention thus activates the actuating device for cold starting the internal combustion engine by manually actuating the same which results in that the throttle gap in the intake pipe is enlarged in that the throttle valve is pivoted by a predetermined angle of rotation amount and the driver can perform the cold starting process as usual, the engine immediately goes into stable idling and the driver can use the motor cycle as usual and can then, for example during a short stationary time or even in a phase, during which the engine is in coasting mode, actuate the accelerator twist grip into closing position of the throttle valve, that is actuate the same by a small angle of rotation amount in forward direction during coasting mode so that the actuating device is deactivated and the cold starting position of the throttle valve is cancelled.

The driver of the motor cycle thus need no longer handle any existing cold starting device on the housing of the throttle valve apparatus for deactivating the cold starting device by directly manually operating the cold starting device on the housing of the throttle valve, which in the case of an engine that has already reached its operating temperature, because of the heat radiation of the engine and/or in the region of the engine and exhaust pipes running in the region of the engine and a throttle valve apparatus poses the risk that the driver burns hand or fingers. The throttle valve apparatus according to the invention thus also ensures a substantial gain in comfort for the driver. The throttle valve apparatus according to the invention is characterized by a simple construction.

According to a further development of the invention it is provided that the actuating device comprises a spring device and an actuating pin that is axially shiftable against the action of the spring device, which can be brought to lie against a stop formed on the control cable drum in such a manner that the throttle valve is pivoted by a predetermined angle of rotation for bringing about an actuated cold starting position of the throttle valve which at least partially opens the through-flow cross section.

When the driver of the vehicle equipped with the throttle valve apparatus according to the invention wishes to carry out a cold start of the internal combustion engine he merely has to axially shift the actuating pin by a predetermined distance so that the axial movement results in that an end section of the actuating pin comes to lie against a stop formed on the control cable drum and further axial movement of the actuating pin, preferentially until the same has assumed an engaged position, results in that the control cable drum is twisted by a predetermined angle of rotation and the rotary movement of the control cable drum is transmitted to the throttle valve via the throttle valve shaft so that the throttle gap in the intake pipe is enlarged corresponding to the air requirement of the internal combustion engine in cold starting mode.

The rotary movement of the control cable drum for bringing about the throttle gap in the intake pipe needed for the cold start is transmitted via the control cable for the closing movement of the throttle valve to the accelerator twist grip of the motor cycle so that the same is automatically twisted into an angle of rotation position which corresponds to a slightly opened accelerator twist grip position and thus a return angle of rotation that is adequate for the closing actuation of the throttle valve for deactivating the actuating device and thus deactivating the cold starting position of the throttle valve is brought about on the accelerator twist grip without the driver having to perform interventions on the motor cycle for this purpose.

According to a further development of the invention it is also provided that the actuating device comprises engagement means which releasably fix the actuating device in the actuated cold starting position of the throttle valve in which it at least partially opens the through-flow cross section. The engagement means ensure that the cold starting position of the throttle valve is maintained until the driver of the vehicle deactivates the actuating device and thus the cold starting position of the throttle valve by actuating the accelerator twist grip against the action of the engagement means in the direction of the closing direction of the throttle valve so that the engagement means disengage from the engagement position and the spring-loaded actuating pin thus jumps back into its starting position in which it is no longer in contact with the stop of the control cable drum.

Here it is provided according to a further development of the invention that the actuating device comprises a sleeve-shaped body formed with an internal recess which is designed for receiving the actuating pin and the actuating pin along a first longitudinally extending section is arranged in a holder formed with an internal recess. This configuration ensures that a relative movement of the actuating pin relative to the holder is possible so that the end section of the actuating pin that can be brought into engagement with the stop on the control cable drum is adjustable with respect to its distance relative to the stop and as a consequence a shifting movement of the holder by a predetermined shifting distance as a function of the mentioned distance leads to a change of the angle of rotation of the control cable drum brought about by the shifting movement of the holder.

With this configuration, the cold starting position angle of rotation of the throttle valve that can be achieved by actuating the actuating device can be engine-specifically changed. With this configuration, a standardised actuating device can be adapted to internal combustion engines showing different cold starting behaviour.

According to a further development of the invention it is provided that the holder is received in the internal recess of the sleeve-shaped body axially shiftably relative to the same and on the outer circumference comprises an indentation which can be brought into releasable engagement with a bulge formed on the internal circumference of the sleeve-shaped body for bringing about an engagement position of the actuating device. In this way, the aforementioned engagement means can be cost-effectively realised, and the holder and the sleeve-shaped body in each case can be formed of a plastic material and axial shifting of the holder and thus of the actuating pin results in that the indentation of the holder comes to lie in the bulge of the sleeve-shaped body and thus an engagement position between the two components and thus the actuating device can be implemented.

According to a further development of the invention it is also provided that the actuating pin in the region of an end section facing an actuation knob comprises a thread section along which the actuating pin is rotatable and axially shiftable relative to the holder that is provided with a corresponding threat section in such a manner that an end section or engagement section projecting out of a housing section of the actuating device, which can be brought to lie against the stop of the control cable drum, can be changed with respect to the projecting length of the end section. In this way, the actuating device can be employed for throttle valve apparatuses of different internal combustion engines with different cold starting behaviour as was already mentioned above.

According to a further development of the invention and alternative embodiment it is also possible that the actuating pin comprises a section which tapers along the longitudinal direction of the actuating pin in the direction of the housing, which interacts with a projection formed on the internal recess of the holder in such a manner that a holding force between the tapering section and the projection is variable. In this way, a holding force that changes, for example increases relative to the holder along the shifting movement of the actuating pin can be realised, which signals to the driver of the vehicle when actuating the actuating device that with increasing holding force the engagement position between the holder and the actuating pin comes nearer. Tactile signalling of the imminent engagement position for the driver is thus possible.

According to a further development of the invention it is also provided that on the tapering section on the region of the actuating pin facing away from the housing a shoulder is formed, behind which the projection of the holder can engage. With increasing holding force, the driver of the vehicle realises that the engagement position of the actuating device is imminent and a further shifting movement of the actuating pin relative to the holder will then result in that the projection of the holder will engage behind the shoulder formed on the actuating pin and the engagement position of the actuating device and thus the predetermined cold starting position of the throttle valve will have been established.

According to a further development of the invention it is also provided that the throttle valve apparatus comprises a first control cable for actuating the throttle valve in opening direction and a second control cable for actuating the throttle valve in closing direction and a twist grip coupling both control cables, wherein an actuation of the twist grip in the direction of the closing direction of the throttle valve subjects the actuating device with a return force which results in the cold starting position of the throttle valve being cancelled. In this way, the throttle valve apparatus according to the invention together with all required components can also be provided as add-on solution for already existing, known motor cycles which are not equipped with the throttle valve apparatus according to the invention and thus experience a technical upgrade connected with a gain in comfort for the user of the vehicle.

Finally, the invention also provides an internal combustion engine with a throttle valve apparatus as was described above and also a motor cycle with a rider's saddle and an internal combustion engine and the throttle valve apparatus according to the invention.

BRIEF DESCRIPTION OF THE DRAWINGS

In the following, the invention is explained in more detail with the help of the drawing. The drawing shows in.

DETAILED DESCRIPTION

Figure 1:
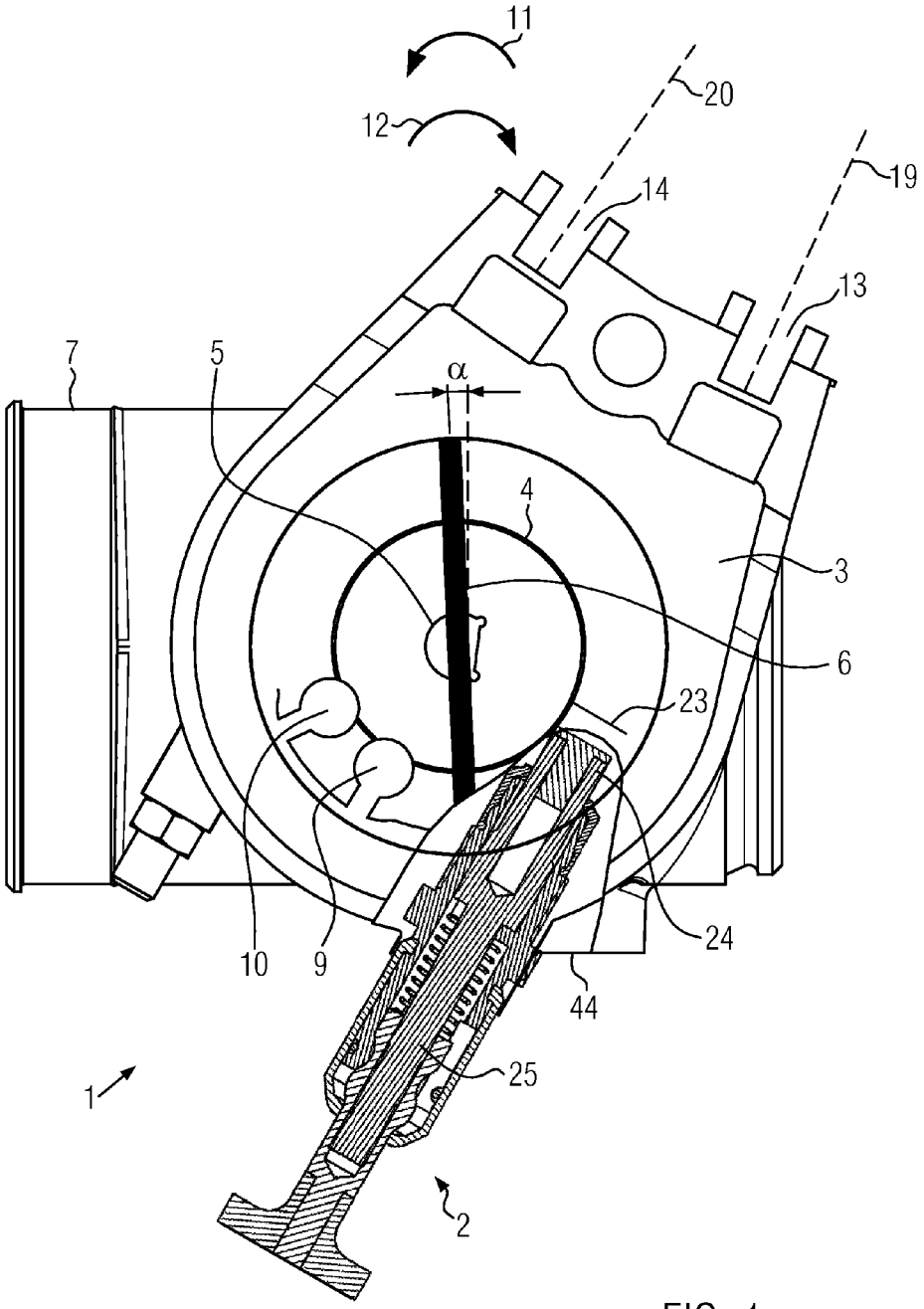
FIG. 1 illustrates a lateral view of a throttle valve apparatus according to an embodiment in accordance with the present invention in an unactuated position of the sectionally represented actuating device.

FIG. 1 of the drawing shows a lateral view of an embodiment of a throttle valve apparatus 1 with an actuating device 2 shown in sectional view in unactuated position.

Figure 2:
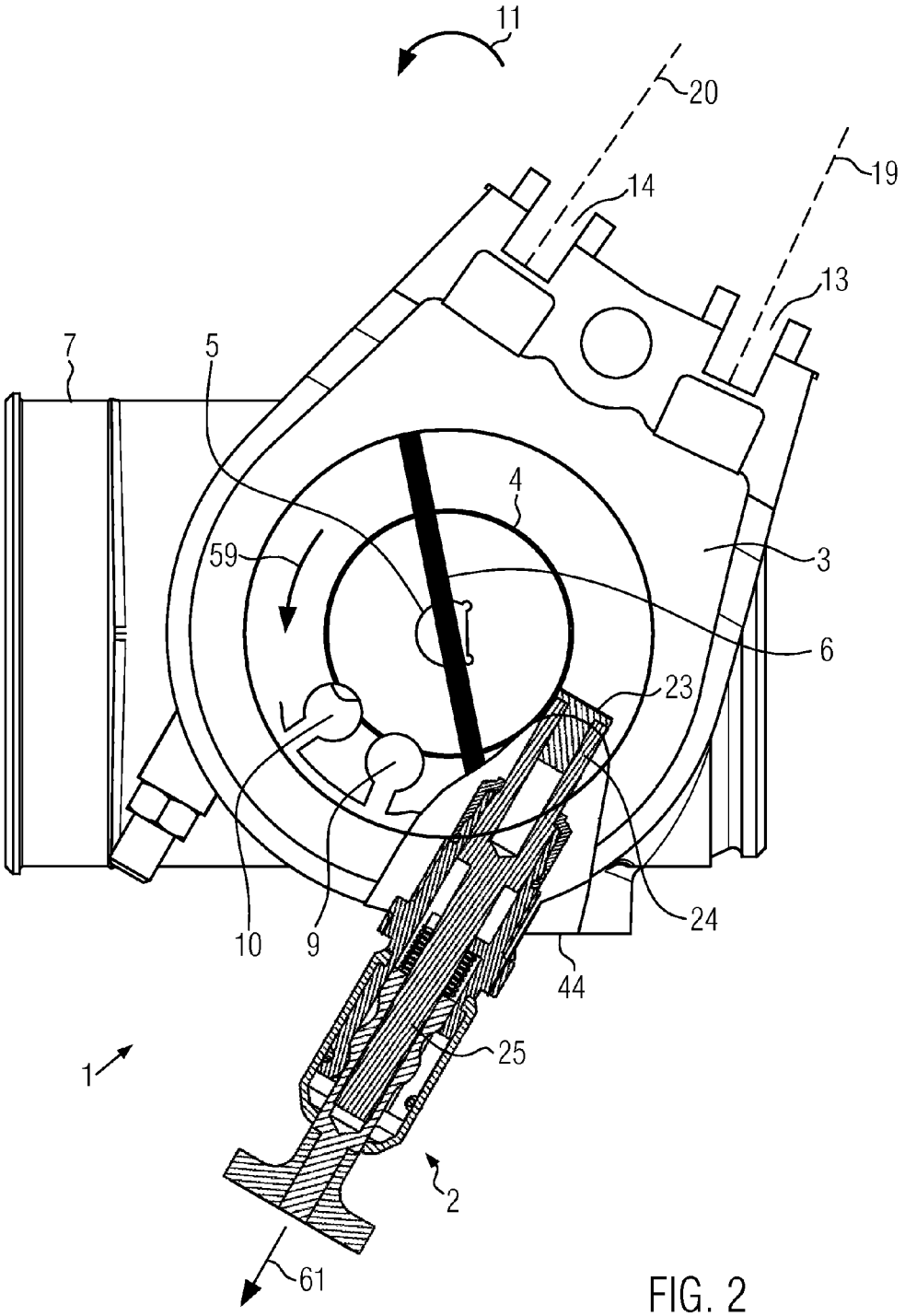
FIG. 2 illustrates a view similar to FIG. 1, in which the actuating device has been actuated and the throttle valve is in the cold starting position.
Figure 3:
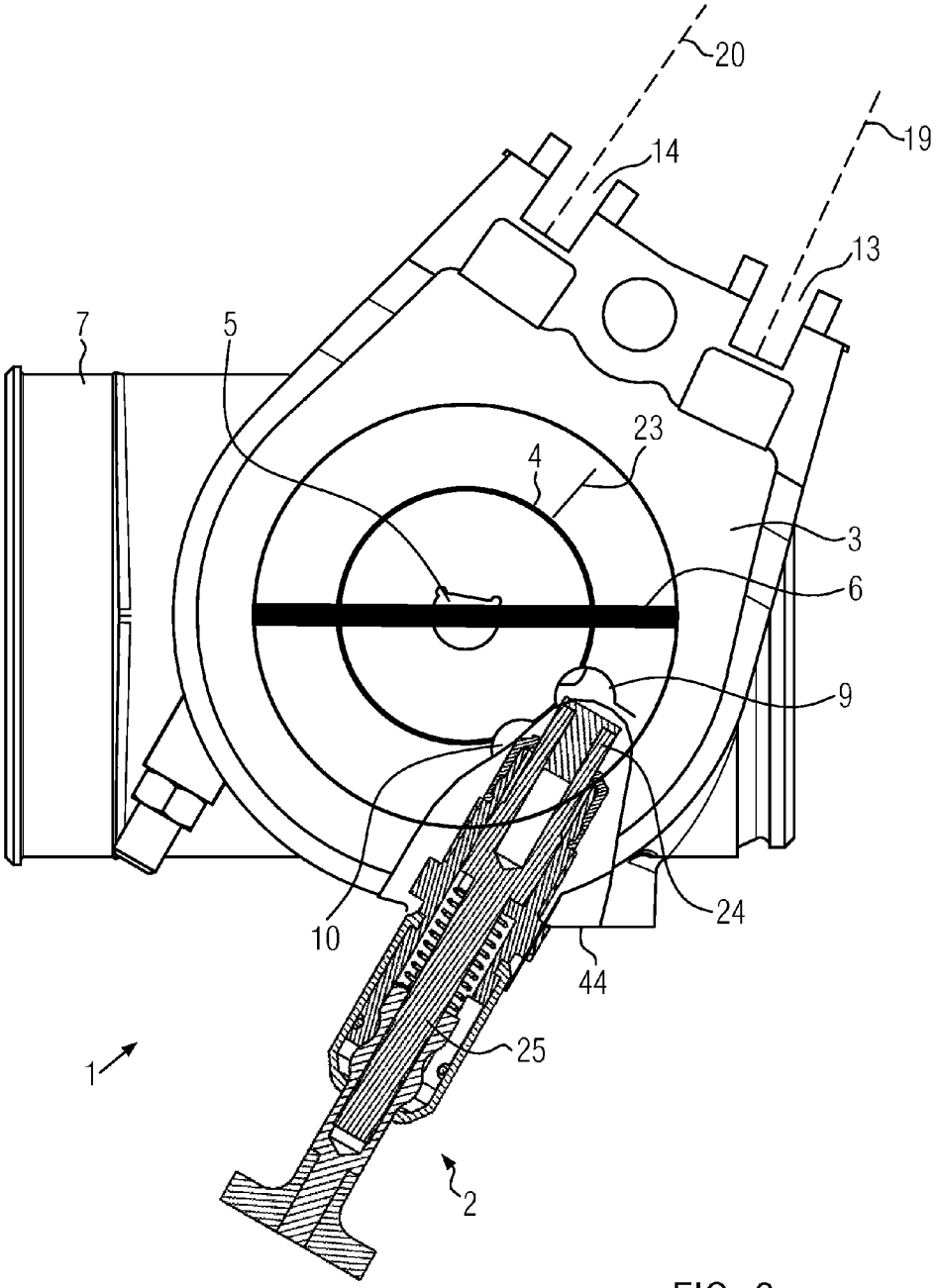
FIG. 3 illustrates a view similar to FIG. 1, in which the throttle valve is completely opened.
Figure 7:
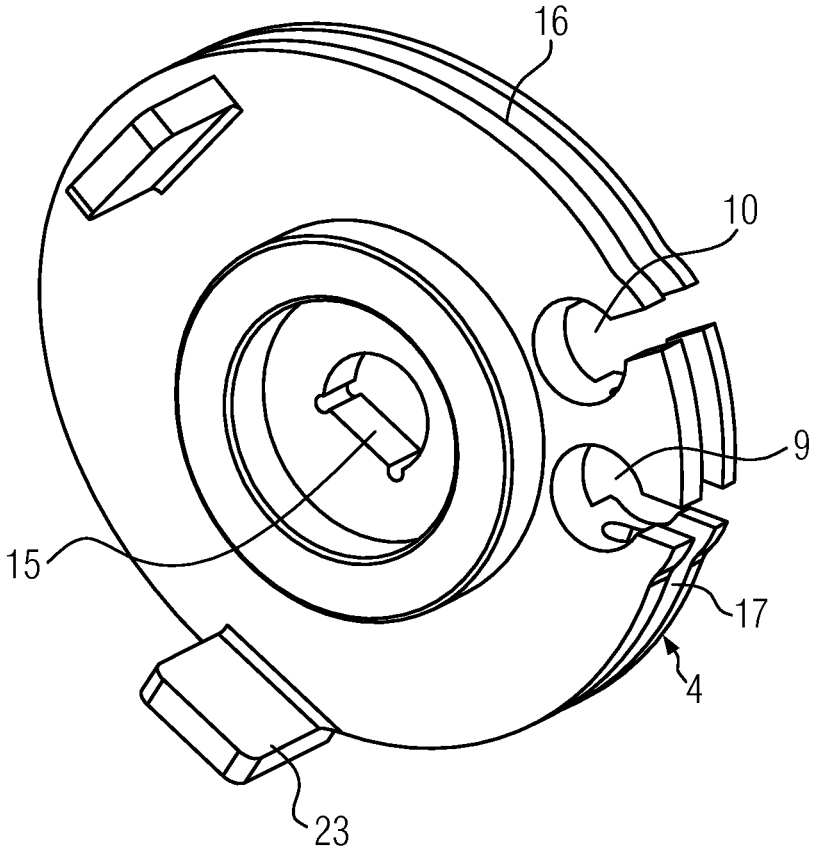
FIG. 7 illustrates a perspective view of a control cable drum of the throttle valve apparatus.

The throttle valve apparatus 1 comprises a housing 3, which is arranged for receiving a control cable drum 4 shown in more detail with the help of FIG. 7 of the drawing and which is shown in FIGS. 1 to 3 of the drawing without side cover, so that a view of the control cable drum 4 schematically shown in FIGS. 1 to 3 is possible.

Figure 11:
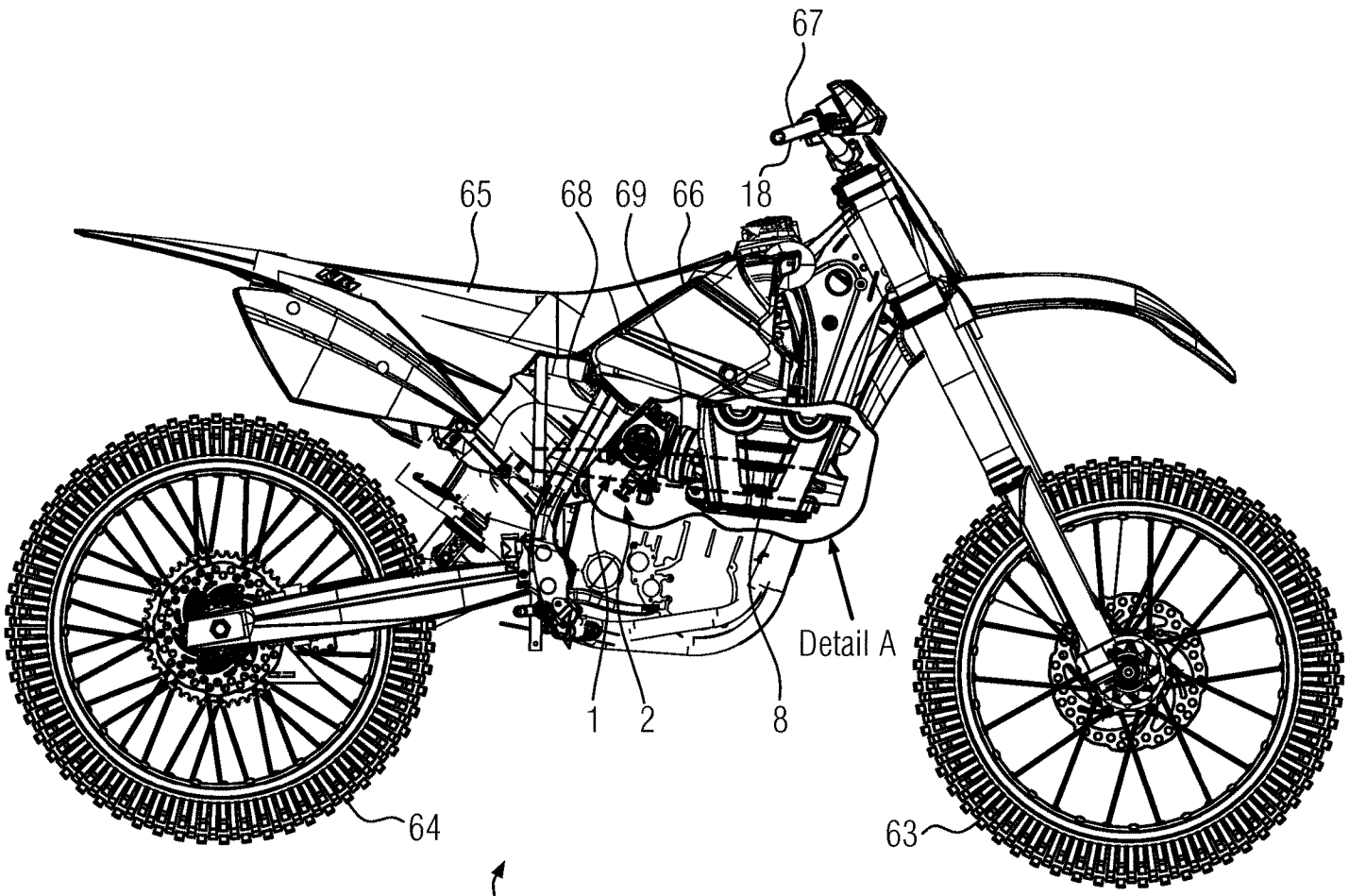
FIG. 11 illustrates a schematic lateral view of a motor cycle with the throttle valve apparatus according to the invention.

The control cable drum 4 is non-positively connected with the throttle valve 6 via a throttle valve shaft 5 so that a relative rotation of the control cable drum 4 via the throttle valve shaft 5 can be transmitted to the throttle valve 6 namely for opening and for closing the throttle valve 6, that is for enlarging and reducing a throttle gap formed between the throttle valve 6 and an intake pipe 7 of an internal combustion engine 8 schematically shown with the help of FIG. 11.

In FIG. 1, the throttle valve 6 is shown in a position which shows the idle speed position of the internal combustion engine 8 at operating temperature. As is easily evident, the throttle valve 6 is shown slightly sloping to the left, i.e. has an opening angle $\alpha$ relative to the vertical of approximately 1 to 3 degrees, so that the internal combustion engine 8 can be supplied with an air-fuel mixture that is adequate for idle speed operation. This position corresponds to the idle speed operating position with the internal combustion engine at operating temperature.

Two control cable receptacles 9, 10 for control cables 19, 20 which are schematically shown in FIG. 1 are formed on the control cable drum 4, wherein the receptacles 9 are provided for receiving a control cable ferrule of a control cable 19 for opening the throttle valve 6 and the receptacle 10 for receiving a control cable ferrule of a control cable 20 for closing the throttle valve 6. The opening movement of the throttle valve 6 in this case takes place in the direction of the arrow 11, while the closing movement of the throttle valve 6 takes place in the direction of the arrow 12 according to FIG. 1.

The control cable 19 for opening the throttle valve 6 in this case enters the housing 3 via an opening 13 of the housing 3 and the control cable 20 for closing the throttle valve 6 enters the housing 3 via an opening 14.

FIG. 7 shows the control cable drum 4 in a perspective view. The control cable drum 4 comprises a recess 15 for receiving the throttle valve shaft 5 and comprises the control cable receptacles 9, 10 already shown and explained in connection with FIG. 1 of the drawing. The control cables can be hooked into the receptacles 9, 10 with the respective control cable ferrules or the control cable ends and then run in the control cable grooves 16, 17 which are evident by way of FIG. 7 of the drawing and exit the housing 3 via the openings 13, 14 and continue further in the direction of the accelerator twist grip 19 shown by way of FIG. 8 of the drawing, as is the case by way of the opening control cable 19 schematically shown in FIG. 1 of the drawing and the closing control cable 20 that is likewise schematically shown.

Figure 9:
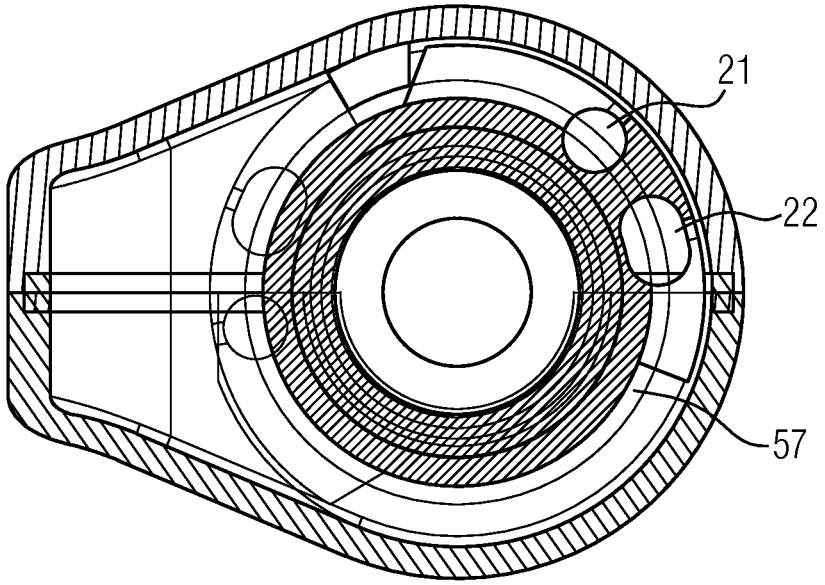
FIG. 9 illustrates a sectional view from the front of the accelerator twist grip according to FIG. 8, which shows the section of the accelerator twist grip on which control cables for actuating the throttle valve can be hooked in, namely in a position which corresponds to the idle speed position of the throttle valve with internal combustion engine at operating temperature.
Figure 10:
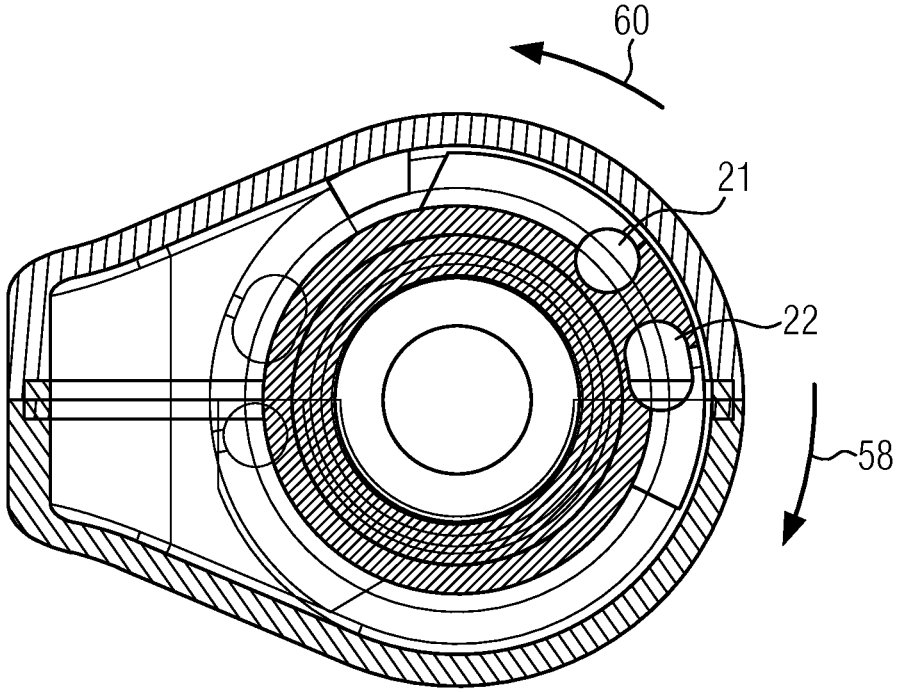
FIG. 10 illustrates a representation similar to FIG. 9, which shows the angle of rotation position with actuated actuating device.

The control cables 19, 20 via control cable ends can then be hooked into control cable receptacles 21, 22 suitably formed on the accelerator twist grip 18, which are evident by way of FIGS. 9, 10 of the drawing.

As is shown by way of FIG. 7 of the drawing, a stop 23 is formed on the control cable drum 4 which is designed in the shape of a disc, which is provided for contacting by an engagement section 24 of an actuating pin 25 of the actuating device 2.

In the idle speed position of the throttle valve 6 shown in FIG. 1 of the drawing, the engagement section 24 is arranged spaced from the stop 23, in other words the engagement section 24 does not lie against the stop 23.

By contrast, with the engagement position of the engagement section 24 with the stop 23 shown in FIG. 2, there is contact between the engagement section 24 and the stop 23, which results in that the throttle valve 6 was rotated in the direction of the arrow 11 and the throttle valve 6 is therefore in the cold starting position, in which the throttle gap compared with the throttle gap in the idle speed operating position of the engine at operating temperature is enlarged, which in turn results in that the started engine receives a larger quantity of air-fuel mixture than is the case in the position of the throttle valve 6 according to FIG. 1 of the drawing.

In FIG. 3 of the drawing, in turn, the stop 23 is out of engagement with the engagement section 24 of the actuating pin 25, since this shows a position of the throttle valve 6 when it is in the position in which it is completely opened by the driver of the vehicle, in other words the driver desires the position of the throttle valve 6 corresponding to full load.

In the following, the actuating device 2 is now described in more detail with the help of FIG. 4 of the drawing.

The actuating device 2 has an overall elongated configuration with an actuating knob 26, which is provided for manual operation by a hand of the driver of the motor cycle according to FIG. 11 of the drawing.

The actuating knob comprises a recess 28, in which an engagement section 29 of the holder 27 can be introduced, for example in the form of a fit similar to a press fit.

The holder 27 likewise has an elongated configuration and comprises an internal recess 30, into which the elongated actuating pin 25 can be introduced. On a first section 31 of the actuating pin 25, the same is provided with an external thread section 32, via which the actuating pin 25 can be screwed into a corresponding section with an internal thread section 33 of the holder 27. By way of the thread, the clear distance 34 (FIG. 4) can be adjusted and thus the distance between the engagement section 24 of the actuating pin 25 and the stop 23 of the control cable drum 4 in the unactuated state of the actuating device 2.

With the thread, it is therefore possible to advantageously react to the cold starting behaviour of different internal combustion engines in such a manner that the clear distance 34 is enlarged for example, as a result of which the distance between the stop 23 and the engagement section 24 is reduced and axial shifting of the actuating pin 25 for bringing about the cold starting position of the throttle valve 6 then ensures a larger throttle gap than with smaller clear distance 34 and the internal combustion engine is then fed a larger quantity of air-fuel mixture for the cold starting operation. In a similar manner, the distance 34 can also be reduced, as a result of which the cold starting position of the throttle valve 6 is then associated with a smaller throttle gap in the intake pipe 7.

Figure 5:
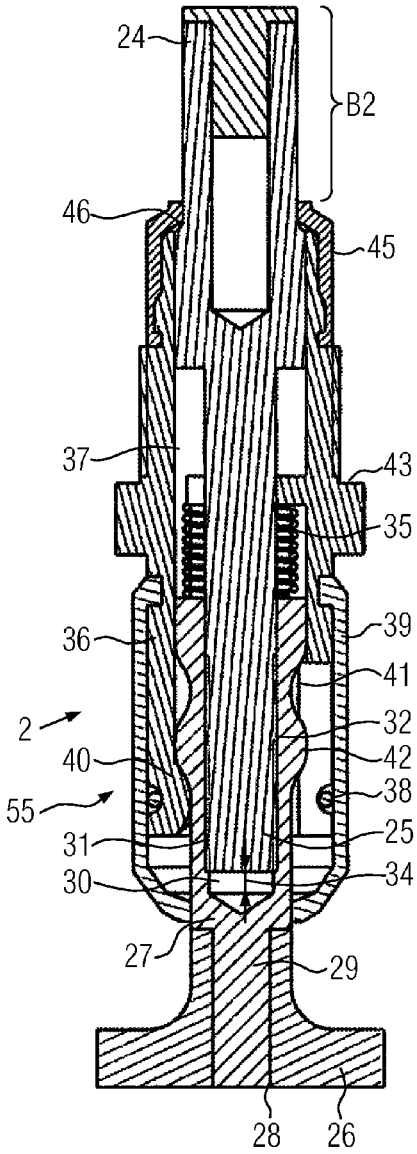
FIG. 5 illustrates a sectional view of the actuating device in the actuated state.

To bring about the actuated position of the actuating device 2 shown in FIG. 5 of the drawing, which leads to a cold starting position of the throttle valve 6, the actuating pin 25 is axially shifted by the user of the vehicle against the action of the spring device designed as coil compression spring 35 with the help of the actuating knob 26 which results in that the actuating device 2 assumes the position shown in FIG. 2. The axial shifting of the actuating knob 26 and thus of the actuating pin 25 also results in that the holder 27 is axially shifted relative to a sleeve-shaped body 36, which is provided with an internal recess 37, as a result of which at the same time an engagement position of the actuating device 2 is brought about.

Figure 4:
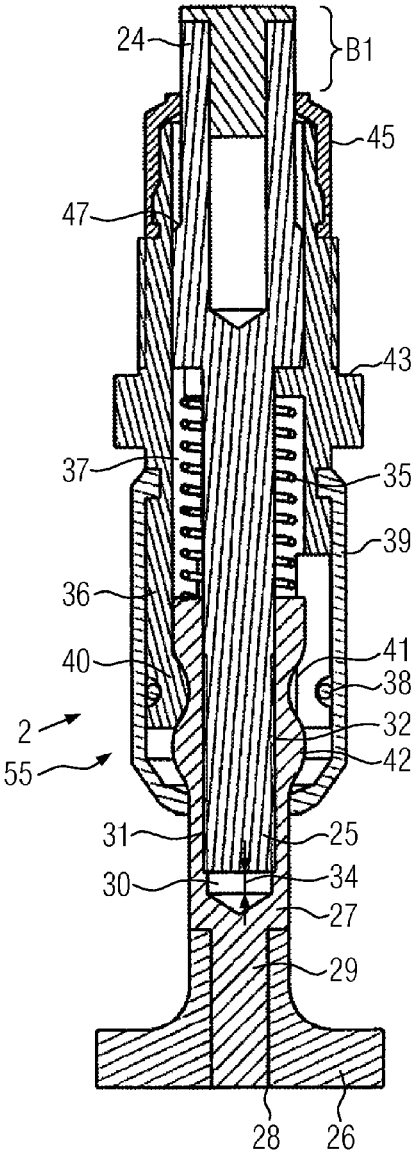
FIG. 4 illustrates a sectional view of the actuating device in the unactuated state.

As is easily evident by way of FIG. 4 of the drawing, the sleeve-shaped body 36 is axially fixed on a housing section 39 of the actuating device 2 via a locking ring 38. The body 36 is provided on the internal recess 37 with a bulge 40, which in the unactuated state of the actuating device 2 is arranged in an indentation 41 on the outer circumference of the holder 27 and an engagement position in the unactuated position of the actuating device 2 can thus be established. The indentation 41 and bulge 40 form engagement means 55, which are provided for maintaining the actuated position of the actuating device.

To bring about an engagement position in the actuated state of the actuating device 2, the actuating pin 25 is axially shifted against the effect of the coil compression spring 35, so that a bulge 42 on the outer circumference of the holder 27 is shifted over the bulge 40 of the sleeve-shaped body 36 and the bulge 42 is pressed against the bulge 40 by means of the now preloaded coil compression spring 35 and an engagement position in the actuated state of the actuating device 2 and thus in the cold starting position of the throttle valve 6 is thus brought about.

As is easily evident by way of FIG. 4 and FIG. 5 of the drawing, the projecting length B1 of the engagement section of the actuating pin 25 in the unactuated position differs from the projecting length B2 of the actuating pin in the actuated position. The change of the projecting length of the engagement section 24 at the transition from the unactuated to the actuated position of the actuating device 2 determines the angle of rotation amount running in the direction of the arrow 11 and thus the quantity of the change of the throttle gap in the intake pipe 7 and adaptation to the starting behaviour of different internal combustion engines is thus achieved.

The actuating device 2 supports itself via a collar 43 on a flange 44 of the housing 2 and in the region of the projecting engagement section 24 comprises a cap 45, which in the region of the upper circumference comprises a shoulder 46, which with a greatest projecting length B2 comes into engagement with a corresponding shoulder 47 formed on the actuating pin 25 in order to avoid further projecting of the engagement section 24.

Figure 6:
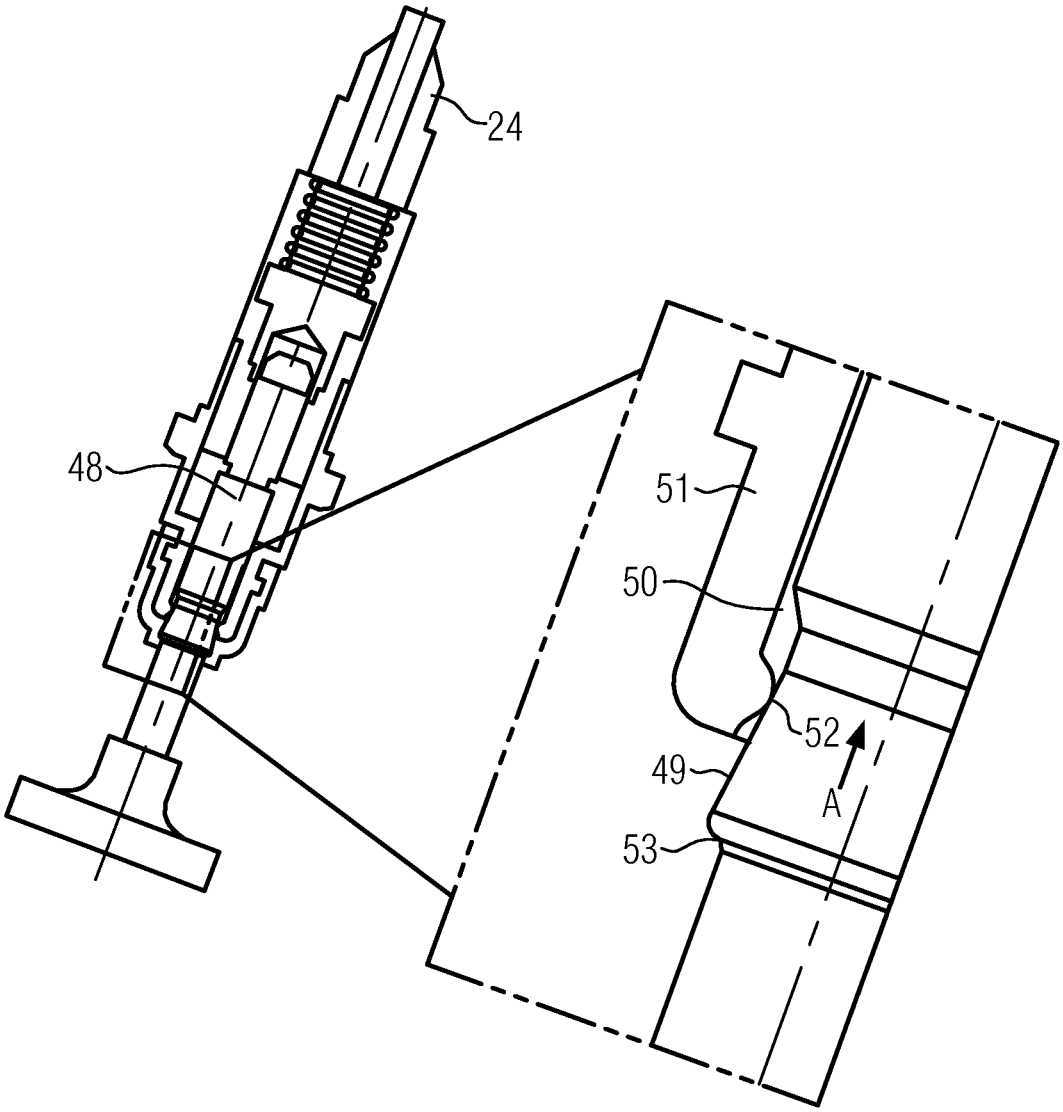
FIG. 6 illustrates a representation of an actuating device according to a modified embodiment.

FIG. 6 of the drawing shows an alternative embodiment of an actuating device 2*a*, which differs from the actuating device 2 according to FIGS. 4 and 5 substantially in that the actuating pin 48 has a section 49 tapering in the direction of the housing 4, which interacts with a protrusion formed on the internal recess 50 of the modified holder 51 in such a manner that a holding force is formed between the tapering section 49 and the protrusion 52.

The holding force rises with the amount of the shifting movement of the actuating pin 48 in the direction of the arrow A (see FIG. 6) and signals to the driver of the vehicle with increasing holding force that upon a further shifting movement of the actuating pin 25 in the direction of the arrow A a shoulder 53 formed on the actuating pin is reached, behind which the protrusion 52 of the holder 51 can engage in order to achieve an engagement position of the modified actuating device 2*a*.

Figure 8:
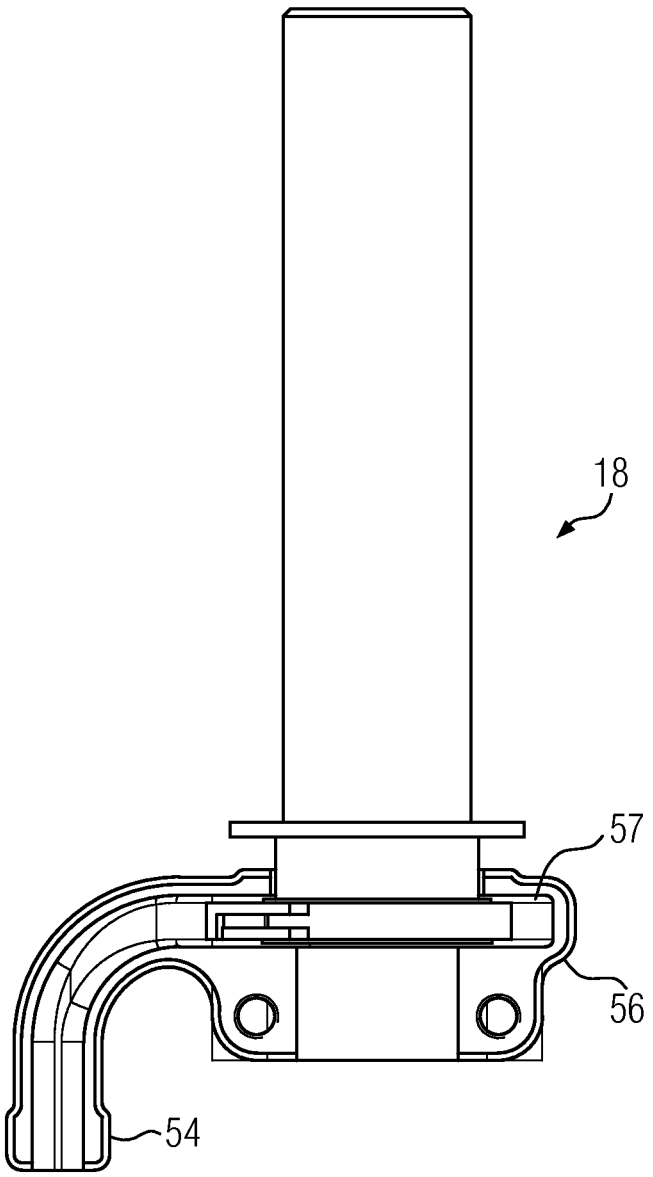
FIG. 8 illustrates a schematic representation of an accelerator twist grip of a motor cycle provided with the throttle valve apparatus according to the invention.

FIG. 8 of the drawing shows a top view of an accelerator twist grip of the motor cycle shown in FIG. 11 of the drawing.

The control cables 19, 20 enter the housing 56 via the guide 54 of the accelerator twist grip 18 where they can be releasably fixed on a control cable disc 57, which is designed similar to the control cable drum 4, namely in such a manner that the control cable ends or control cable ferrules facing the accelerator twist grip 18 are introduced into the control cable receptacles 21, 22 and fixed there.

The control cable receptacle 21 in this case serves to receive the control cable end of the opening control cable 19 while the control cable receptacle 22 serves for receiving the control cable end of the closing control cable 20.

FIG. 9 of the drawing shows the accelerator twist grip 18 in the idle speed position of the internal combustion engine in the state at operating temperature, i.e. the position corresponding to FIG. 1, while FIG. 10 shows the position of the accelerator twist grip 18, which corresponds to the position of the throttle valve 6 according to FIG. 2, i.e. the cold starting position.

As is easily visible, the accelerator twist grip 18 according to FIG. 10 has been rotated approximately 5 degrees in the direction of the arrow 58, i.e. in the direction in which the accelerator twist grip 18 is twisted corresponding to the opening direction of the throttle valve 6.

This position of the accelerator twist grip 18 according to FIG. 10 materialises since at the transition from the unactuated position of the throttle valve apparatus 1 according to FIG. 1 into the actuated position according to FIG. 2 the receptacle 10 for the closing control cable 20 performs a rotary movement corresponding to the arrow 59 according to FIG. 2 and the accelerator twist grip 18 thus follows the rotary movement of the control cable drum 4 and thus of the throttle valve 6.

Once the internal combustion engine 8 which is not yet at operating temperature has been started specifically with the cold starting position of the throttle valve 6 corresponding to FIG. 2, the driver of the motor cycle can perform his driving operations with the motor cycle that are familiar to him via a suitable actuation of the accelerator twist grip 18 and for example in particular when the internal combustion engine 8 is in coasting mode, i.e. the accelerator twist grip 18 is closed, exert a pulling force on the closing control cable 20 designated by the arrow F via actuation of the accelerator twist grip in the direction of the arrow 60 according to FIG. 10, that is in the direction of the closing direction of the throttle valve 6.

This pulling force results in that via the stop 23 of the control cable drum 4 a compressive force acting in the direction of the arrow 61 according to FIG. 2 is exerted on the actuating pin 25 which, supported by the spring force of the preloaded coil compression spring 37, lets the actuating device 2 jump back into its unactuated position namely from the engagement position of the actuating device shown in FIG. 5 of the drawing into the unactuated position shown in FIG. 4. Thus, the cold starting position of the throttle valve 6 is cancelled and the driver need not directly perform any manipulations on the actuating device 2 for this purpose but can perform this via the accelerator twist grip 18 by way of remote access.

To illustrate why this is advantageous, reference is made to FIG. 11 of the drawing. The same shows a motor cycle 62 which is equipped with the throttle valve apparatus 1 according to the invention. For the sake of illustration, the internal combustion engine 8 as detail "A" is shown enlarged in order to be able to better explain the position of the throttle valve apparatus 1.

As is easily visible, the actuating device 2 on the throttle valve apparatus 1 is arranged on the motor cycle 62 orientated downwards in direction, as a result of which it is achieved that in the case of a possible component defect of the actuating device 2 the throttle valve 6 cannot unintentionally assume its cold starting position and thus the throttle gap in the intake pipe 7 not unintentionally enlarged.

The motor cycle 62 in the shown example is an off road sports motor cycle provided for competition purposes with a front wheel 63, a rear wheel 64, a rider's saddle 65, a fuel tank 66 and handle bars 67, on which the accelerator twist grip 18 shown by way of FIG. 8 is arranged.

Figure 12:
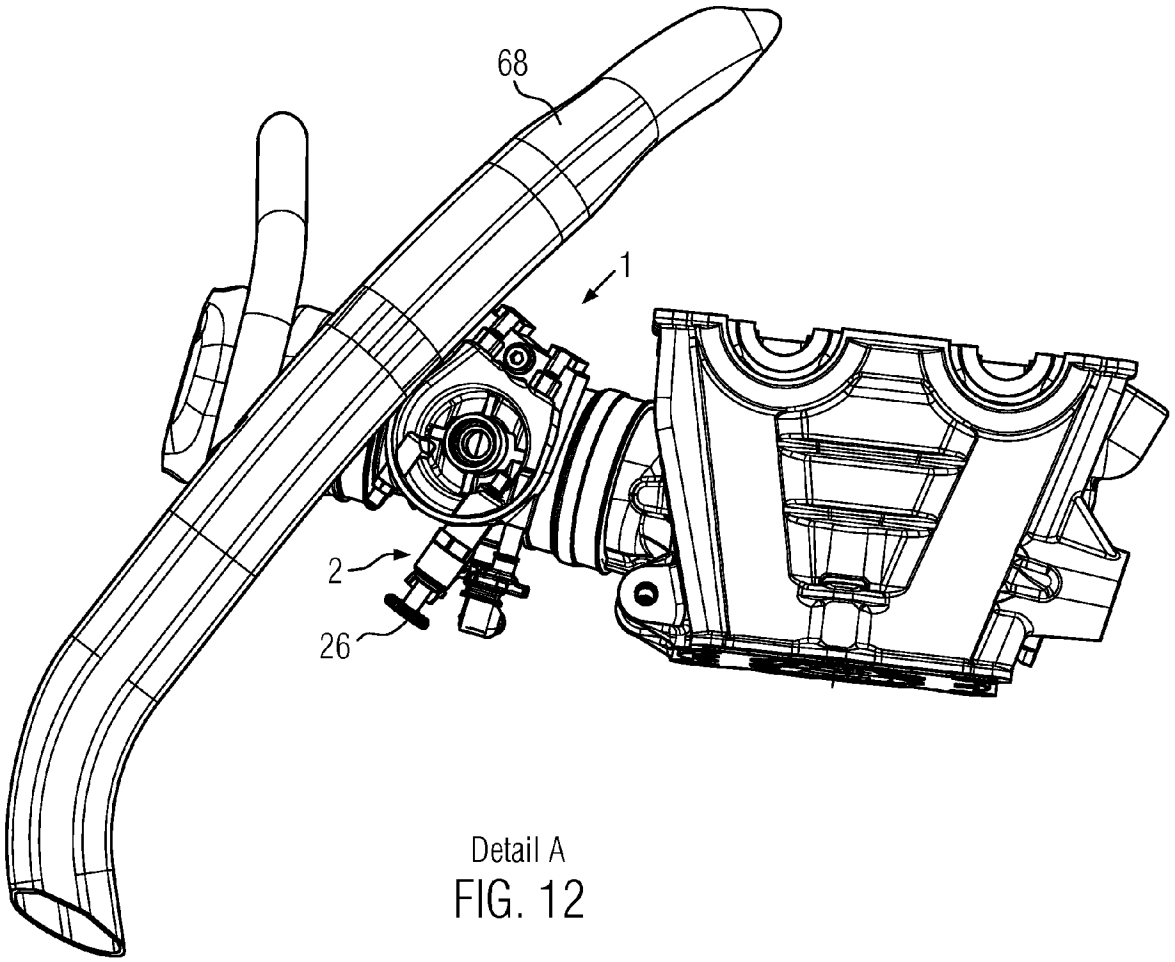
FIG. 12 illustrates an enlarged representation of the detail "A" from FIG. 11.

As is evident by way of FIG. 12 of the drawing, the driver of the motor cycle 62 can reach the throttle valve apparatus 1 arranged adjacent to the frame tube 68 and the actuating device 2 for activating the cold starting position arranged thereon even in particular when he already sits on the rider's saddle 65 and for activating the cold starting position merely has to slide the actuating knob 26 from his view in upward direction as a result of which the cold starting position is activated.

Once the internal combustion engine 8 has been started, be it by means of an electrical starting device or by means of a kick starter, the internal combustion engine 8 immediately assumes a stable idle speed in the cold starting mode and the driver can directly drive away without having to bring the engine up to operating temperature while stationary, as has been usual in the field of off-road sports up to now. After a short time, the internal combustion engine has reached its operating temperature and the driver of the motor cycle actuates the accelerator twist grip 18 in the direction of the closing position of the throttle valve 6 as has already been explained above. Thus, the driver need no longer actuate the cold starting position by manually actuating the actuating device 2 directly on the throttle valve apparatus 1 but can deactivate the cold starting position of the throttle valve 6 via remote access by simply actuating the accelerator twist grip 18 against the opening direction of the throttle valve. This leads to a substantial gain in comfort for the driver even since with off road sports motor cycles, the exhaust pipe 69 emanating from the internal combustion engine 8 is often directly routed to the back at the height of the internal combustion engine, as is the case in the exhaust pipe 69 shown in FIG. 11 of the drawing in a stylised manner.

With cold exhaust pipe, there is no problem for the driver of the motor cycle 62 in activating the actuating device 2 which is arranged directly next to the exhaust pipe 69 or adjacent to the exhaust manifold while deactivation through direct manipulation of the actuating device with hot exhaust pipe poses the risk of injury to the hand or the fingers of the driver. This problem is elegantly solved in that the driver of the vehicle can simply and securely deactivate the cold starting position of the throttle valve by actuating the accelerator twist grip in closing direction of the throttle valve.

With respect to features of the invention which are not explained in more detail above, reference is otherwise expressly made to the patent claims and the drawing.

REFERENCE LIST

1 Throttle valve apparatus
2 Actuating device
3 Housing
4 Control cable drum
5 Throttle valve shaft
6 Throttle valve
7 Intake pipe
8 Internal combustion engine
9 Receptacle
10 Receptacle
11 Arrow opening movement
12 Arrow closing movement
13 Opening
14 Opening
15 Recess
16 Control cable groove
17 Control cable groove
18 Accelerator twist grip
19 Opening control cable
20 Closing control cable
21 Control cable receptacle
22 Control cable receptacle
23 Stop
24 Engagement section
25 Actuating pin
26 Actuating knob
27 Holder
28 Recess
29 Engagement section
30 Internal recess
31 First section
32 External thread section
33 Internal thread section
34 Clear distance
35 Coil compression spring
36 Sleeve-shaped body
37 Internal recess
38 Locking ring
39 Housing section
40 Bulge
41 Indentation
42 Bulge
43 Collar
44 Flange
45 Cap
46 Shoulder
47 Shoulder
48 Actuating pin
49 Tapering section
50 Internal recess of the holder
51 Holder
52 Protrusion
53 Shoulder
54 Guide
55 Engagement means
56 Housing
57 Control cable disc
58 Opening direction
59 Arrow
60 Arrow
61 Compressive force
62 Motor cycle
63 Front wheel
64 Rear wheel
65 Riders saddle
66 Fuel tank
67 Handle bar
68 Frame tube
69 Exhaust pipe

What is claimed is:

1. A throttle valve apparatus for an internal combustion engine comprising:

a housing; and an intake pipe, the intake pipe comprising:

a through-flow cross section and a throttle valve that is pivotable relative to the through-flow cross section, which is actuatable by means of a throttle valve shaft, characterized by an actuating device arranged on the housing, by means of which the throttle valve is releasably fixable in a cold starting position in which the through-flow cross section is at least partially opened.

2. The throttle valve apparatus according to claim 1, wherein the throttle valve shaft is actuatable in opening direction of the throttle valve by means of at least one control cable and the control cable is arranged operationally connected with a control cable drum arranged in the housing, the control cable drum being coupled to the throttle valve shaft.

3. The throttle valve apparatus according to claim 1, wherein the throttle valve shaft is actuatable in closing direction of the throttle valve by means of at least one control cable and the control cable is arranged operationally connected with a control cable drum arranged in the housing, the control cable drum being coupled to the throttle valve shaft.

4. The throttle valve apparatus according to claim 1, wherein the actuating device is designed for manual actuation for bringing about the cold starting position of the throttle valve which at least partially opens the through-flow cross section and for cancelling this position.

5. The throttle valve apparatus according to claim 1, wherein the actuating device is designed for cancelling the cold starting position of the throttle valve in which the through-flow cross section is at least partially opened by means of actuation by a control cable.

6. The throttle valve apparatus according to claim 1, wherein the actuating device can be brought, by means of a control cable actuating the throttle valve in closing direction, from the actuated cold starting position of the throttle valve in which the through-flow cross section is at least partially opened into a position of the throttle valve that is unactuated by the actuating device.

7. The throttle valve apparatus according to claim 1, wherein the actuating device comprises a spring device and an actuating pin which is axially shiftable against the effect of the spring device, which can be brought to lie against a stop formed on the control cable drum in such a manner that the throttle valve is pivotable by a predetermined angle of rotation for bringing about an actuated cold starting position of the throttle valve in which the through-flow cross section is at least partially opened.

8. The throttle valve apparatus according to claim 1, wherein the actuating device comprises engagement means, which releasably fix the actuating device in the actuated cold starting position of the throttle valve in which the through-flow cross section is at least partially opened.

9. The throttle valve apparatus according to claim 7, wherein the actuating device comprises a sleeve-shaped body formed with an internal recess, which is designed for receiving the actuating pin and the actuating pin is arranged along a holder formed along a first section running alongside designed with an internal recess.

10. The throttle valve apparatus according to claim 8, wherein the actuating device comprises a sleeve-shaped body formed with an internal recess, which is designed for receiving the actuating pin and the actuating pin is arranged along a holder formed along a first section running alongside designed with an internal recess.

11. The throttle valve apparatus according to claim 9, wherein the holder is axially shiftably received in the internal recess of the sleeve-shaped body relative to the same and on the outer circumference comprises an indentation, which can be brought into releasable engagement with a bulge formed on the inner circumference of the sleeve-shaped body for bringing about an engagement position of the actuating device.

12. The throttle valve apparatus according to claim 10, wherein the holder is axially shiftably received in the internal recess of the sleeve-shaped body relative to the same and on the outer circumference comprises an indentation, which can be brought into releasable engagement with a bulge formed on the inner circumference of the sleeve-shaped body for bringing about an engagement position of the actuating device.

13. The throttle valve apparatus according to claim 12, wherein the actuating pin in the region of an end section facing an actuating knob comprises a thread section, along which the actuating pin is rotatable and axially shiftable relative to the holder which is provided with a corresponding thread section in such a manner that an end section projecting out of a housing section of the actuating device, which can be brought to lie against the stop of the control cable drum, is variable with respect to the projecting length of the end section.

14. The throttle valve apparatus according to claim 1, wherein the actuating pin comprises a section which along the longitudinal direction of the actuating pin tapers in the direction of the housing, which interacts with a protrusion formed on the internal recess of the holder in such a manner that a holding force between the tapering section and the protrusion is variable.

15. The throttle valve apparatus according to claim 14, characterized in that on the tapering section on the region of the actuating pin facing away from the housing a shoulder is formed, behind which the protrusion of the holder can engage.

16. The throttle valve apparatus according to claim 1, wherein a first control cable for actuating the throttle valve in opening direction and a second control cable for actuating the throttle valve in closing direction and an accelerator twist grip coupled to both control cables, wherein actuation of the accelerator twist grip in the direction of the closing direction of the throttle valve applies a return force on the actuating device which leads to a cancellation of the cold starting position of the throttle valve.

17. An internal combustion engine with a throttle valve apparatus, the throttle valve apparatus comprising:

a housing; and an intake pipe, the intake pipe comprising:

a through-flow cross section and a throttle valve that is pivotable relative to the through-flow cross section, which is actuatable by means of a throttle valve shaft, characterized by an actuating device arranged on the housing, by means of which the throttle valve can be releasably fixed in a cold starting position in which the through-flow cross section is at least partially opened.

18. The throttle valve apparatus according to claim 17, wherein the throttle valve shaft is actuatable in opening direction of the throttle valve by means of at least one control cable and the control cable is arranged operationally connected with a control cable drum arranged in the housing, which is coupled to the throttle valve shaft.

19. The throttle valve apparatus according to claim 18, wherein the throttle valve shaft is actuatable in closing direction of the throttle valve by means of at least one control cable and the control cable is arranged operationally connected with a control cable drum arranged in the housing, which is coupled to the throttle valve shaft.

20. A motor cycle with a rider's saddle and an internal combustion engine, the internal combustion engine having a throttle valve apparatus comprising:

a housing; and an intake pipe, the intake pipe comprising:

a through-flow cross section and a throttle valve that is pivotable relative to the through-flow cross section, which is actuatable by means of a throttle valve shaft, characterized by an actuating device arranged on the housing, by means of which the throttle valve can be releasably fixed in a cold starting position in which the through-flow cross section is at least partially opened.

* * * * *